United States Patent [19]

Lamb et al.

[11] 4,040,524

[45] Aug. 9, 1977

[54] APPARATUS FOR HANDLING PIPE AT WELL SITE

[75] Inventors: William C. Lamb, Lafayette; Rodney J. Wetzel, St. Martinville, both of La.

[73] Assignee: Lamb Industries, Inc., Lafayette, La.

[21] Appl. No.: 150,331

[22] Filed: June 7, 1971

[51] Int. Cl.[2] ..... E21B 19/00

[52] U.S. Cl. ..... 214/2.5; 175/85; 212/73; 214/1 P; 104/112

[58] Field of Search ..... 104/112, 113, 114, 115, 104/116, 117; 214/2.5, 13, 1 P, 94; 212/73, 72, 74, 125; 175/52, 85

[56] References Cited

U.S. PATENT DOCUMENTS

| | | | |
|---|---|---|---|
| 448,766 | 3/1891 | Kelliher | 104/115 |
| 535,938 | 3/1895 | Boyton | 104/113 X |
| 814,933 | 3/1906 | Bendickson | 104/112 X |
| 890,306 | 6/1908 | Schmertz | 214/2.5 X |
| 929,196 | 7/1909 | Davison | 104/117 X |
| 1,053,305 | 2/1913 | Leue | 212/72 |
| 1,714,183 | 5/1929 | McPhee | 104/112 |
| 1,804,175 | 5/1931 | Massey | 212/73 |
| 2,135,245 | 11/1938 | Uyehara | 104/113 X |
| 2,425,292 | 8/1947 | McCoy | 214/2.5 |
| 3,065,865 | 11/1962 | Barker | 214/2.5 |
| 3,225,702 | 12/1965 | Hill | 104/114 |
| 3,254,776 | 6/1966 | Brown | 214/1 P X |
| 3,388,070 | 6/1968 | Born et al. | 254/172 |
| 3,538,855 | 11/1970 | St. Cyr | 104/117 X |
| 3,825,129 | 7/1974 | Beck | 214/2.5 |

FOREIGN PATENT DOCUMENTS

| | | | |
|---|---|---|---|
| 1,185,771 | 3/1970 | United Kingdom | 254/172 |
| 1,189,622 | 4/1970 | United Kingdom | 212/72 |

*Primary Examiner*—Frank E. Werner
*Attorney, Agent, or Firm*—Fulbright & Jaworski

[57] ABSTRACT

A pipe handling device for transporting pipe, drill collars, or like tubular members between the elevated drilling floor of a well derrick and a lower storage area has a pair of support cables extending between the rig floor and the storage area. A pipe trolley means rides the support cables and is movable along the support cables by a third cable to transport pipe from the storage area to the rig or to lay pipe down from the rig to storage. A cable draw works, typically in the vicinity of the storage area, anchors one end of the support cables and is provided with a take-up mechanism for the support cables to enable them to be slackened to enable a pipe to be loaded into or unloaded from the pipe trolley means in the storage area and thence tensioned to facilitate the travel of the trolley to the elevated rig floor.

5 Claims, 11 Drawing Figures

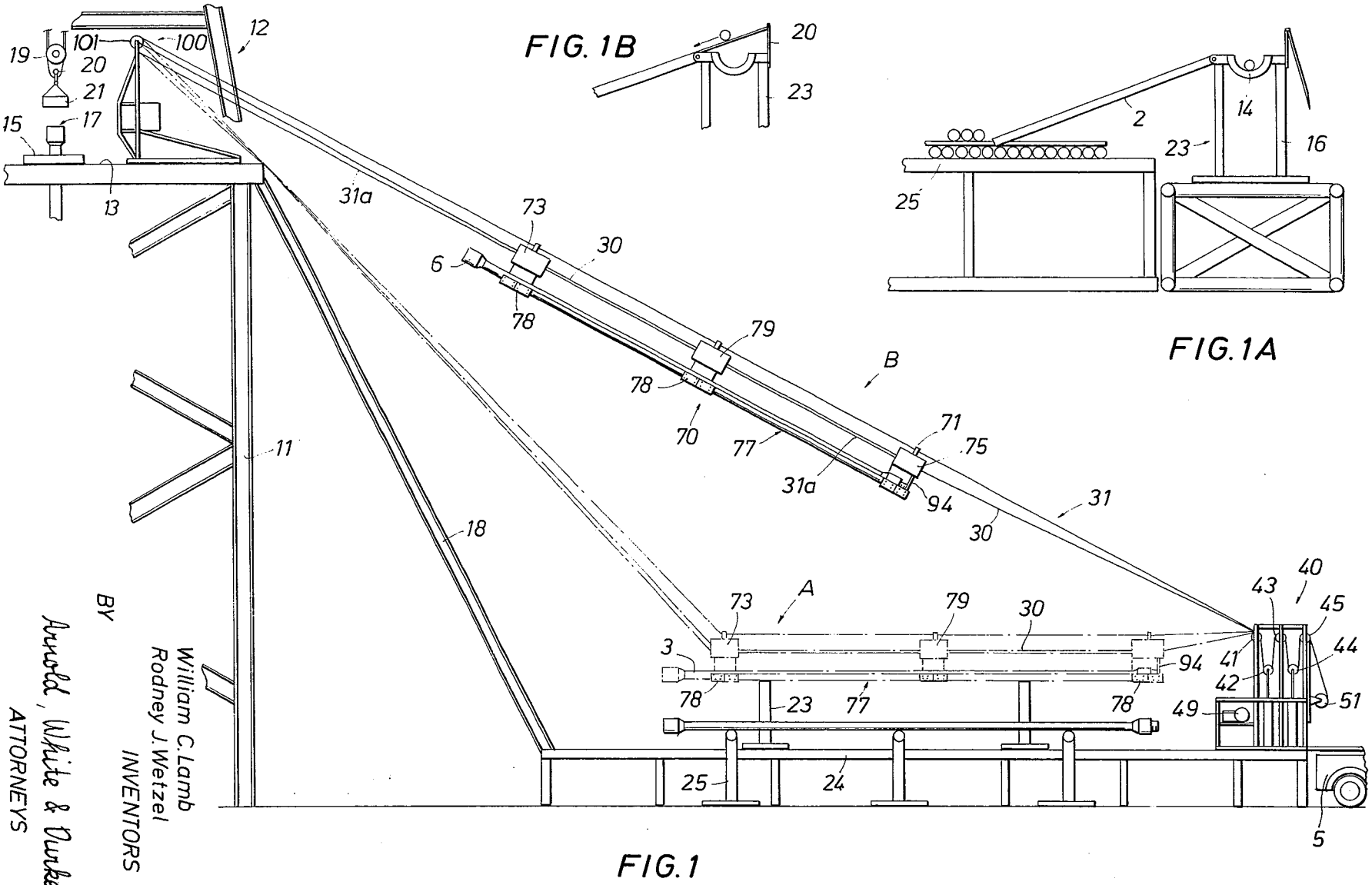
William C. Lamb
Rodney J. Wetzel
INVENTORS
BY
Arnold, White & Durkee
ATTORNEYS William C. Lamb
Rodney J. Wetzel
INVENTORS

BY

Arnold, White & Durkee
ATTORNEYS

William C. Lamb
Rodney J. Wetzel
INVENTORS

BY

Arnold, White & Durkee
ATTORNEYS

FIG. 7
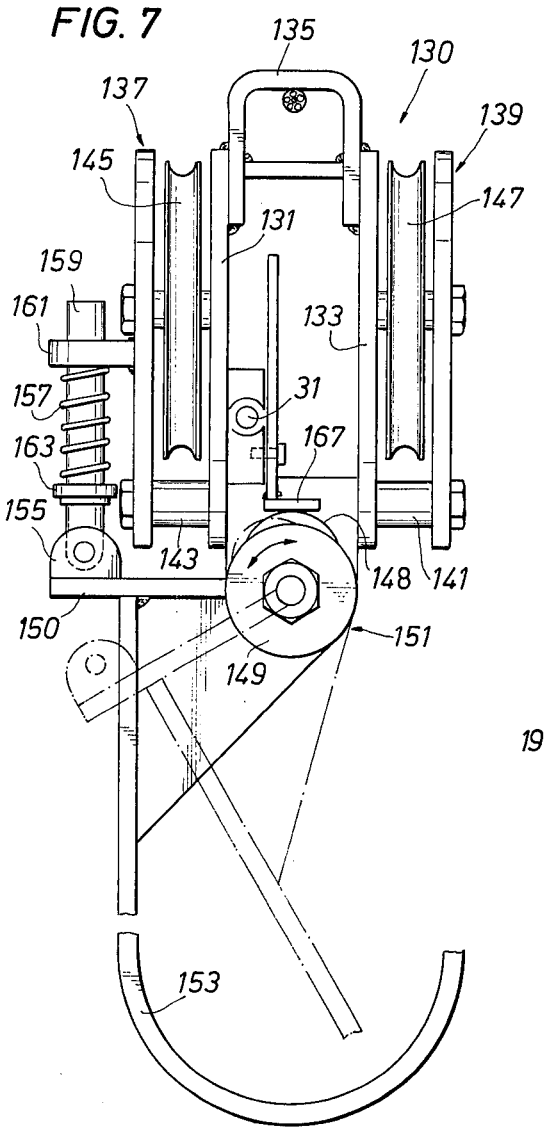
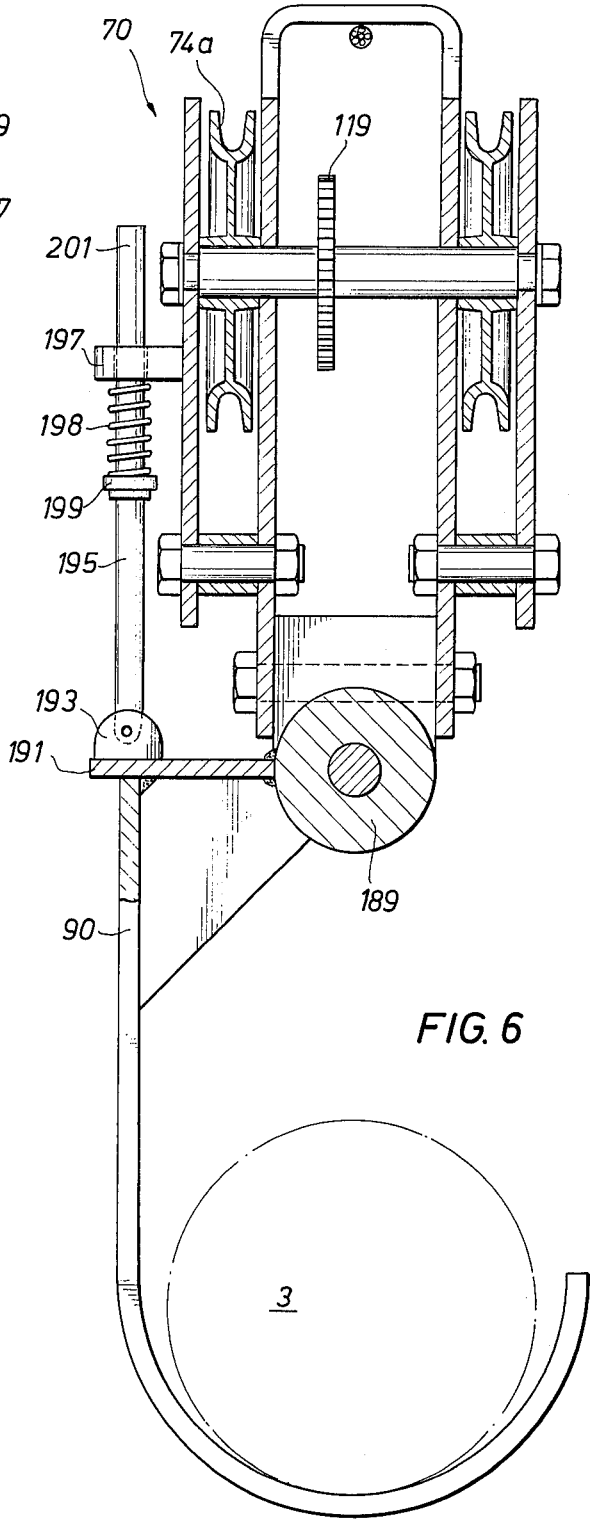
FIG. 6
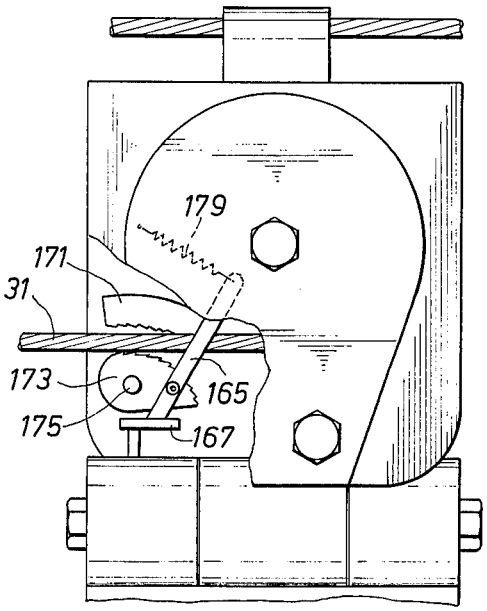
FIG. 8
William C. Lamb
Rodney J. Wetzel
INVENTORS
BY
Arnold, White & Durkee
ATTORNEYS William C. Lamb
Rodney J. Wetzel
INVENTORS

BY

Arnold, White & Durkee
ATTORNEYS

APPARATUS FOR HANDLING PIPE AT WELL SITE

BACKGROUND OF THE INVENTION

The instant invention relates to a method and apparatus for handling pipelike members, e.g., drill pipe, drill collars, well tubing, etc., at a well drilling site. More particularly, this invention provides a cable transport mechanism which may be used either to deliver pipe to the elevated rig floor of a well derrick or to lay down pipe from the rig floor to a lower storage area. Hence, the apparatus and method herein may be employed throughout the drilling operation for pipe handling tasks.

At the well site where an oil well is being drilled or reworked, it is necessary that provision be made for handling of the drill pipe, well tubing, well casing, or drill collars which are used in the well. For example, during the drilling operation, it is continually necessary to provide additional lengths of drill pipe or the like to the derrick as the drilling progresses. Similarly, when the drilling operation is concluded or when problems are encountered during drilling, it may be necessary or desirable to remove the drilling string from the borehole. Accordingly, the operators at the well site are constantly confronted with the problem of efficiently handling the various tubular members used during the drilling operation, and of transporting these tubular members between the rig floor and a nearby storage area where the collars and drill pipe are typically maintained on racks in a stand-by position.

It has been customary in handling pipe or other tubular goods at a well site to provide an inclined trough or skidway adjacent the open side of the derrick to facilitate the transfer of the pipe from the drilling rig substructure, called the rig floor, and the pipe rack storage area. However, due to the weight of these tubular members, such relatively uncontrolled handling can result in damage to thread connections, and also because of the inordinate amount of manual handling which is required, can result in injury to workers at the well site.

Considerable attention has been directed toward devising various types of drill pipe handling apparatus in order to facilitate transfer of tubular goods from the pipe storage area to the usually elevated rig floor of the derrick substructure, and subsequently to transfer the same back to the storage area. One approach has been to provide a mechanical device with a pipe holding trough which will accept a length of pipe from the storage area and thereafter lift the pipe or incline it in order to "feed" the pipe upwardly toward the rig floor. Illustrative of such devices is U.S. Pat. No. 3,559,821. Alternatively, powered trolleys riding on tracks could be provided to transport the pipe from the rig floor to the storage area or vice versa, as shown in U.S. Pat. No. 3,268,095 and the like.

Another approach has been to use a cable transport system to handle the pipe. A cable system has inherent advantages in that it can be most easily adapted to the conditions at the well site. Unlike purely mechanical systems, cable systems can usually be adapted to deliver pipe from a convenient storage area, which may be in a different position at different well sites to the rig floor, which may vary in elevation depending upon the particular well being drilled. U.S. Pat. Nos. 3,532,229 and 3,368,699 disclose cable systems for handling pipe at a well site. But in these patents, the pipe is secured only at one end to the cable system, and hence manual attention of the workers is required to prevent damage to the free end of the pipe. Moreover, the systems disclosed in these patents rely to significant extent upon the use of the traditional pipe skidway.

Other cable systems for pipe handling are disclosed in U.S. Pat. Nos. 3,065,865, 2,690,846, 2,539,751, and 2,425,292.

SUMMARY OF THE INVENTION

According to the invention herein, there is provided a pipe handling system and method for use at a well drilling site, utilizing cables to effect the transfer of pipe between an elevated rig floor and a lower pipe storage area. It will be understood herein that reference to the handling of "pipe" shall include reference to all the various elongated pipelike members which require handling at the well drilling site, e.g., drill pipe, drill collars, well casing, tubing, or the like.

One feature of the instant invention is the provision of support cables supported at one end in the vicinity of the storage area and at the opposite end in the vicinity of the rig floor. These support cables function as a track for a pipe holding trolley means which preferably supports the pipe at least at two spaced points proximate the ends of the pipe and transports the pipe between the rig floor and the storage area. The support cables are fixed at one end, and at the other end are accepted in a draw works assembly capable of selectively increasing or decreasing the unsupported length of the support cables by a fixed amount. Thus, the support cables can first be slackened so as to assume a catenary-like position for loading and unloading the pipe wherein the pipe trolley means can be disposed in substantially horizontal position in the pipe storage area to enable ready acceptance or discharge of pipe. The draw works can then tension the support cables by the fixed amount so that they will assume a substantially direct slope from the storage area to the rig floor during pipe transport.

The pipe trolleys are not propelled by movement of the support cables. The only movement which the support cables undergo is the repeated slackening to enable the pipe to be accepted or discharged in the storage area followed by tensioning to provide the substantially direct inclined track between the storage area and the rig floor.

The draw works means repeatedly will take up or let out a fixed length of the support cable and thus the apparatus of this invention eliminates difficulties attendant upon using an operator controlled winch which must be closely and constantly monitored to assure that excess tension is not imposed upon the support cables during the tightening operation or that too much slack is introduced into the support cables during the loading and unloading operation. The draw works comprises fixed cable sheaves and at least one selectively movable sheave for each support cable. The support cable is wound alternately from a fixed sheave around a movable sheave and ultimately is anchored in the draw works. Thus, by selectively moving the movable sheave or sheaves, a preselected length of cable can be taken up or let out in the draw works, thereby changing the unsupported length of cable between the storage area and the rig floor. By tensioning the support cables, the substantially direct incline between the two areas is established, and by slackening the cables, the cables will assume a catenary shape facilitating the acceptance or discharge of pipe onto horizontal racks in the lower storage area.

The pipe trolley means used in the apparatus of this invention may be an elongated, rigid trough adapted to support each pipe joint substantially along its entire length. Alternatively, the pipe trolley means may comprise two separate trolleys adapted to receive the ends of the pipe. The rigid trough trolley is preferred for transport of pipe from the lower storage area to the rig floor, while the twin trolley arrangement is preferred in the reverse operation as will be developed in the subsequent disclosure. The trolley means are moved on the support cables by means independent of the support cable, preferably a separate trolley cable. Depending upon the particular pipe handling function to be performed, the trolley means may be provided with brakes, with means to selectively engage the trolley cable upon receiving the pipe, or with means to latch into position at the rig floor location while pipe is being transferred to or from the trolleys.

In summary, this invention provides a method for transporting pipelike members between the elevated floor of a well derrick and a lower storage area which comprises supporting a cable at a first support point in the vicinity of the elevated floor of the derrick and at a second support point in the vicinity of the storage area; supporting the pipelike member to be transported at least at two spaced points along the pipe by means of a movable trolley which is adapted for travel along the support cable; moving the pipelike member along the cable between the support points; and selectively changing the length of the cables between the support points by a fixed amount to enable the cable to assume a slackened catenary position wherein the two spaced points at which the pipe is supported are disposed substantially horizontally in the vicinity of the storage area, and the second tension position wherein the cable means extends in a substantially direct incline from the storage area to the elevator floor.

In the apparatus of this invention suitable support cable means, trolley means, cable tensioning means, and means to move the trolley are provided to effect the method.

BRIEF DESCRIPTION OF THE DRAWINGS

The instant invention will be more particularly understood with reference to those particular embodiments of the invention as illustrated in the accompanying drawings.

FIG. 1 is an overall view showing the arrangement of the apparatus of this invention proximate a well derrick in order to perform the necessary pipe handling functions.

FIG. 1A is an end view of the pipe rack apparatus maintained in the storage area and shown in the embodiment typically used when transporting pipe from the storage area to the elevated rig floor.

FIG. 1B shows an alternate embodiment of the pipe rack used in the lay down operation when pipe is transported from the rig to the storage area.

FIG. 6 is a sectional view of the twin sheave trolley along line 6—6.

FIG. 7 is a side elevational view of a single sheave pipe trolley which is preferred for use in accordance with this invention.

FIG. 8 is a sectional view of the single sheave trolley of FIG. 7.

DESCRIPTION OF THE SPECIFIC AND PREFERRED EMBODIMENTS

Figure 3:
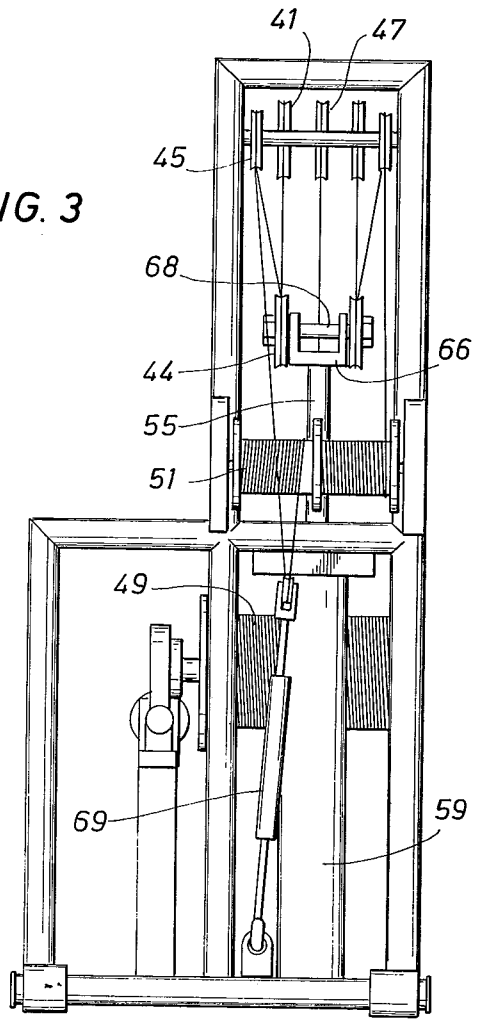
FIG. 3 is an end view of the cable draw works assembly shown in FIG. 2.

Referring now to FIG. 1, the apparatus of this invention is shown operationally disposed approximate well drilling derrick 11. Derrick 11 is conventional for drilling operations and has a rig floor 13 on which there is provided a standard rotary table 15 from which the drilling string is suspended in conventional manner. The end of the uppermost joint of pipe in the drilling string is visible at 17.

The upper portion of the derrick is not shown, but conventionally comprises an upper platform from which is supported a traveling block 19. Elevator 21 is suspended from traveling block 19 on swivel 20. The elevator is a standard oil field tool for handling of pipe within the derrick and is used to pick up pipe from the pipe handling apparatus of this invention when going into the well, and to deliver pipe for transport to storage by the apparatus of this invention when coming out of the well.

The pipe handling apparatus of this invention is disposed to one side of the derrick. Access to the derrick is had through the V-door opening 12 between the structural members of the derrick, the V-door being of sufficient size to accommodate the pipe lengths being used. A conventional pipe skidway 18 also extends in the direction of the pipe handling apparatus from V-door 12.

In the storage area, a skid assembly 23 is provided atop catwalk 24. The height of skid assembly 23 may be selectively varied in order to facilitate the transfer of pipe between pipe storage rack 25 and the pipe handling section of the skid assembly. Truck 5 is disposed proximate to catwalk 24 and contains a hydraulic power unit for operation of the apparatus, accordingly rendering the entire apparatus readily transportable to drilling sites as needed.

With reference to the apparatus of this invention, the position of the apparatus as shown in the loading or unloading position in dotted line at A, while the arrangement of the apparatus in the pipe transporting position is shown at B. In both instances, side-by-side support cables 30 are fixed at their upper end at support stand 100 which is chained to rig floor 13. The lower end of support cables 30 are supported by and pass through support sheaves 41 of draw works assembly 40 and thence into the draw works alternately around movable sheaves 42 and 44 fixed sheaves 43 and 45 as will be explained below.

Trolley means 70 is shown with pipe 3 in position therein and comprises upper trolley 73 and lower trolley 75 with a rigid pipe receiving trough 77 disposed therebetween. An auxiliary support trolley 79 may be disposed between the upper and lower trolleys to assist in supporting the load of trolley means 70. The side-by-side support cables 30 run below sheaves in each of the trolleys supporting the trolleys and providing a track for movement of the entire trolley means between the storage area and the vicinity of the rig floor. Trolley cable 31 extends upwardly from lower trolley sheave 47 (not visible in FIG. 1) in draw works 40 through cable guides such as at 71 in lower trolley 75 and then around upper trolley sheave 101 in support stand 100. The return length of trolley cable 31, shown at 31*a* passes through upper trolley 73 and auxiliary trolley 79 and is affixed to lower trolley 75. At its opposite end trolley cable 31 extends downwardly from lower trolley sheave 47 to winch 49.

In draw works assembly 40, support cables 30 pass over support sheaves 41, and thence alternately around movable sheaves 42, fixed sheave 43, movable sheave 44, and fixed sheave 45. The ends of the support cable are then anchored on drum 51 which remains in fixed position during the pipe handling operation. Movable sheaves 42 and 44 are rotatably mounted on the upper ends of shafts 53 and 55 which are operatively connected to the pistons of hydraulic cylinders 57 and 59, respectively. Accordingly, upon proper actuation of the controls movable sheaves 42 and 44 (shown in the downward or retracted position in FIG. 1) move upwardly reducing the amount of support cable collected in draw works 40 and thereby increasing the unsupported length of said support cables between support sheaves 41 and support stand 100. As will be further developed hereinbelow, by appropriate adjustment of the draw works assembly, the retraction of movable sheaves 42 and 44 will produce a substantially direct incline of support cables 30 from support sheave 41 to support stand 100, while extension of the movable sheaves 42 and 44 will slacken the support cables and cause them to assume an open "catenary" position in which the trolley means 70 can be disposed in a substantially horizontal position proximate to the skid assembly in order to accept or discharge lengths of pipe.

It should be explained that when reference herein is made to the support cables assuming a catenary position upon extension of movable sheaves 42 and 44, it is not intended to imply that the support cables will in fact demonstrate the gradual curve characteristic of catenaries. Rather because of the weight of the trolley means 70, and the weight of any pipe such as pipe 3 in said trolley means, the slackened support cables will in fact assume a configuration such as shown in FIG. 1 at A wherein the cables are substantially straight between support stand 100 and upper trolley 73, and substantially straight between lower trolley 75 and support sheave 41. Accordingly, the weight of the trolley means 70 and any pipe contained therein effectively deforms the catenary. Nonetheless, it will be understood that when reference is made to the support cables being in a "catenary-like" position, a reference to this slackened condition is intended.

OPERATION

To briefly summarize the operation of the apparatus of this invention, reference will first be had to the operation wherein pipe is delivered from the storage area to rig floor 13. To accomplish pipe pickup, movable sheaves 42 and 44 are in the extended position thus producing the slackened or catenary-like condition of support cables 30. The trolley means 70 is then aligned with skid assembly 23 and pipe 3 is placed in the pipe receiving trough 77. Once the pipe 3 is firmly in the trough, movable sheaves 42 and 44 are retracted and support cables 30 tighten to produce a substantially straight incline from support sheave 41 to support stand 100. Simultaneously winch 49 may be activated to reel in trolley cable 31 and thereby prevent trolley means from sliding backwardly into draw works assembly 40. Once the support cables 30 are in the tensioned position, winch 49 is again activated to further reel in trolley cable 31 to pull the trolley means with the pipe upwardly toward rig floor 13. When the upper end 6 of pipe 3 is extending over rig floor 13, the operation of winch 49 is stopped and the trolley cable holds the trolley means 70 in position. An operator may then affix elevator 21 to the upper end 6 of the pipe and lift the pipe from trolley means 70. As the elevator lifts the pipe the lower end of pipe 3 will be guided in trough 77. When the pipe is removed from trolley means 70, the trolley cable 31 is paid out by winch 49 until it reaches an inclined position substantially over the skid assembly. At that point movable sheaves 42 and 44 are extended slowly permitting the support cables to slacken and permitting the trolley means 70 to be positioned again on the skid assembly to pick up another joint of pipe. During this latter procedure, winch 49 is used to control the trolley cable and assist in the positioning of the trolley means.

During the pipe transfer operation it is only necessary for an operator to attend on winch 49 and to make the appropriate extension and retraction of movable sheaves 42 and 44. However, since the extension and retraction of the movable sheaves increases and decreases the unsupported length of the support cables by a fixed amount which has been pre-adjusted, the position of the support cables in the slackened and the tensioned position is readily reproduceable. It only becomes necessary therefore to attend on winch 49 which controls trolley cable 31 to assist in positioning the pipe. Moreover, since trolley means 70 is freely movable along support cables 30 by trolley cable 31, the operation of winch 49 does not introduce the possibility of imposing excessive amounts of tension on the cable system.

It will be apparent that the transport of pipe from the rig floor to the storage area can be accomplished in substantially the reversed manner. That is, the lower end of a length of pipe suspended from elevator 21 can be placed in trolley means 70 and lowered until the lower end is accommodated in lower trolley 75. The elevator 21 is then disconnected from the pipe and the trolley means is permitted to proceed down support cables 30 by paying out trolley cable 31 from winch 49. When the pipe is disposed in inclined position above the skid assembly, the movable sheaves are extended and the support cables will assume a catenary-like position enabling the pipe to be discharged from the trolley means on the skid assembly.

However, it is pointed out that, particularly in the pipe lay down operation, it may be preferable to use two independent trolleys, such as trolleys 73 and 75 without rigid trough 77 disposed between them. In this regard, it will be noted that rigid trough 77 is preferably connected to trolleys 73 and 75 by means of bolts 78 to permit its disassembly from the trolleys. In addition, auxiliary trolley 79 can be removed from support cables 30.

In the take-down operation using two independent trolleys, the two trolleys are initially arranged proximate support stand 100. Trolley cable 31 is attached to the lower trolley, such as 75, while upper trolley 73 may be latched in position at the support stand or may otherwise be held in position by a suitable braking clamp around the support cable 30 as will be hereinafter explained. A length of pipe supported by elevator 21 is then placed in lower trolley 75, and trolley cable 31 is paid out permitting the lower trolley to advance down the support cables as the elevator lowers the length of pipe. The opposite end of pipe is then placed in the upper trolley which remained clamped or latched at the support stand, and the weight of the pipe unlatches the upper trolley and permits the upper trolley to travel down support cables supporting the upper end of the pipe. Suitable means may be provided in the upper trolley to engage the pipe and thereby maintain the trolleys in spaced position when the support cables are disposed in a steeply inclined position. For example, spring loaded tong members may be provided in the pipe receiving bucket to grip the pipe. Alternatively, a braking apparatus such as disclosed herein may be used. Winch 49 continues to pay out trolley cable 31 until the pipe is disposed in inclined position over the skid assembly after which the movable sheaves 42 and 44 are displaced from their retracted to their extended position thereby producing the slackened effect in support cables 30 and permitting the pipe to be deposited on the skid assembly.

It will be appreciated that the twin trolley arrangement can likewise be employed to transport pipe from the storage area to the rig floor. In such an operation, however, care must be exercised after the elevator has been engaged onto the upper end of the pipe length, to coordinate the lifting action of the elevator with the upward travel of the lower trolley in order to prevent a too rapid operation of the elevator from displacing the lower end of the pipe from the lower trolley and thereby possibly causing damage to the pipe.

DETAIL OF APPARATUS

Referring to FIG. 1A, there is shown a sectional view of an embodiment of a skid assembly and pipe rack arrangement. It is pointed out that any suitable skid assembly and pipe racking apparatus may be employed with the pipe handling system of this invention. The illustrated skid assembly 23 in FIG. 1A is preferably employed in transporting pipe from the storage area to the rig floor and provides a pipe alignment support 14 suitable for receiving a pipe length which has been rolled up ramp 2 from pipe rack 25 preparatory to pickup. Alternatively, alignment support 14 might accommodate trough 77 of trolley means 70. Legs 16 of skid assemby 23 may be of a telescoping nature and be hydraulically adjustable to set the height of the alignment support 14 conveniently with respect to the pipe on the pipe rack 25.

In taking pipe down, the inclined ramp 20 as shown in FIG. 1B may be placed over alignment support 14. As the trolleys are lowered with the pipe suspended therebetween, incline 20 will lift the pipe from the buckets in the trolleys and roll the pipe approrpriately onto the storage rack.

Figure 2:
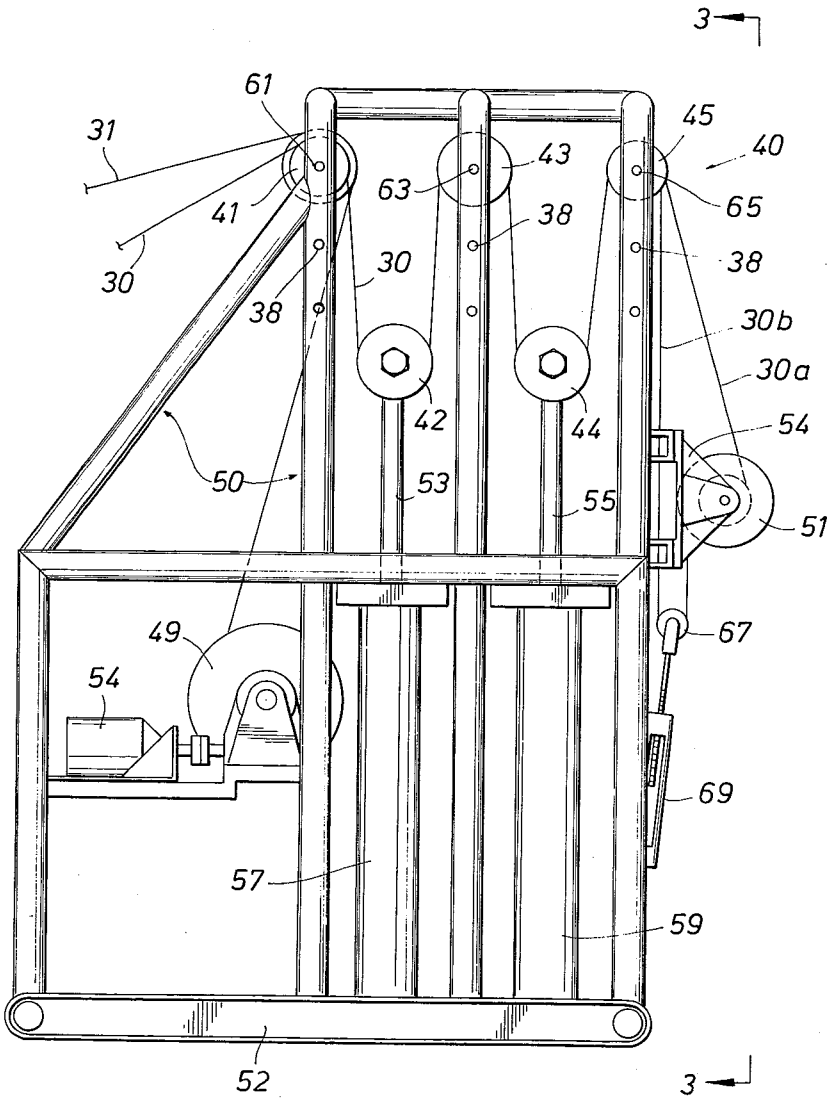
FIG. 2 is a side elevational view of one embodiment of a cable draw works assembly which may be used in accordance with the instant invention.

The draw works assembly 40 is shown in detail in FIGS. 2 and 3. The draw works assembly 40 is provided with a frame 50 of pipelike members welded into a unitary construction. A suitable skid 52 which can be chained to catwalk 24 provides the base of the assembly. Within the draw works are a series of fixed sheaves and movable sheaves. Support sheaves 41 are affixed in position on shaft 61 supported by the works frame 50. Additional fixed sheaves are disposed at 43 and 45 for rotation about shaft 63 and shaft 65, respectively, which are likewise supported in the works frame. Movable sheaves 42 and 44 are adapted for vertical movement on the ends of shafts of hydraulic cylinders and are disposed intermediate the pairs of fixed sheaves.

Support cables 30 enter the draw works assembly over the pair of support sheaves 41. It will be appreciated that a single support cable might be employed in the cable system of this invention, but the use of two side-by-side support cables is preferred, both from the standpoint of trolley stability during the pipe transport operation and because of safety considerations. The fixed sheaves and movable sheaves are disposed at alternate stations in the general or overall direction of cable travel through the draw works, i.e., generally to the right in FIG. 2. Hence while the sheaves always bear perpendicularly on the cable, the movable sheaves also move perpendicularly to the overall direction of cable travel in the draw works. The support cables travel over fixed sheaves 41 and downwardly beneath movable sheaves 42. Thence the support cables alternately travel around fixed sheaves 43, movable sheaves 44, and finally above fixed sheaves 45, so that the cable-engaging surface of each sheave imposes a force on the cable opposite to that of adjacent sheaves. The forward pair of movable sheaves 42 is aligned with the rearward pair of movable sheaves 44 as can be seen in FIG. 3. Likewise, the intermediate and rearward pair of fixed sheaves are similarly aligned so that the oscillating pattern of each cable substantially defines a plane as it passes through draw works 40. Trolley cable 31 passes over lower trolley sheave 47 located in the middle of shaft 61, and directly to wind-up drum 49 which is bidirectionally powered by hydraulic motor 54.

The ends of the two support cables shown at **30*a* and 30*b* come off fixed sheaves and are anchored to drum 51 which may be provided with a power take-off to enable powered rotation. Drum 51 is mounted on the rear frame members of the draw works by mount 54. It will be appreciated that it is important to the operation of the pipe handling system of the invention to maintain the support cables under substantially equal tension during the various pipe handling operations, and it is preferred to provide a tension adjusting means in the anchoring mechanism for the support cables. An attempt to obtain equal tension by merely winding the two cables around the same drum would be virtually impossible. Accordingly, while first support cable 30*a* is wound directly on drum 51, support cable 30*b* extends below tensioning pulley 67 and then is wound about drum 51. Tensioning pulley 67 is anchored to skid 52 of the draw works through turnbuckle 69. Accordingly, equalizing the tension of the support cables can be readily accomplished by first loosening turnbuckle 69, adjusting the proper tension on line 30*a* by use of drum 51 alone, and thereafter tightening the turnbuckle 69 to produce an equal tension in line 30*b***. Other tension equalizing systems might be employed and will be appreciated by those skilled in the art. For example, a separate takeup drum could be provided for each support cable. However, such a system is less efficient, might require multiple adjustments, and would be more bulky than that proposed.

Each of the movable sheaves 42 and 44 are rotatably mounted on a shaft such as 68 shown mounting sheaves 44 in FIG. 3. Shaft 68 is adapted for rotation through U-block 66 which is affixed to the upper end of shaft 55 of hydraulic cylinder 59. By means of hydraulic controls, shafts 53 and 55 of the hydraulic cylinders may be selectively extended from and retracted into the hydraulic cylinders, thereby letting out from the draw works or taking up within the draw works a predetermined length of cable. Once the adjustment of this predetermined length is made for an individual pipe transport operation, repeated actuation of the cylinders will then take up or let out a fixed amount of support cables.

Accordingly, a total vertical travel of three feet by each of the movable sheaves in the draw works illustrated in FIG. 2 will provide a capability of the draw works to alter the unsupported length of support cables by twelve feet. In most operations, a twelve-foot increase in the length of the support cables will be sufficient to provide a catenary-like slackening of the support cables sufficient to accommodate a pipe transport operation wherein the vertical distance between the storage area and the rig floor is about forty feet. The draw works can be adjusted, however, to provide a lesser amount of cable takeup, for example, by mounting the fixed sheaves in auxiliary shaft holes 38. When such adjustments are made, however, it must be kept in mind that the fixed sheaves should not be lowered to a point where their upper surface is below the lower surface of the movable sheave since it is desirable to preserve the oscillating configuration of the cable in the draw works. It will be appreciated that the draw works assembly of this invention could be given in increased capability of cable takeup or release by altering the total vertical travel of the movable sheaves by making suitable adjustments in the hydraulic cylinders. Alternatively, additional stations of movable sheaves and fixed sheaves could be provided in order to increase the takeup and release capability. If a reduced capability is desired, one of the movable sheaves, preferably forward sheave 42 could be tied down in its hydraulic cylinder, thus rendering only sheaves 44 responsive to the hydraulic control. Finally, the total vertical travel of the hydraulic cylinders might be adjusted, though such adjustments are often only difficultly accomplished. It will therefore be understood that the draw works of this invention can be transported to the well site, and by the positioning of the draw works as well as by making adjustments as set forth above, the appropriate amount of cable slackening and tensioning can be determined and will be reproduced throughout the pipe handling operation.

Figure 4:
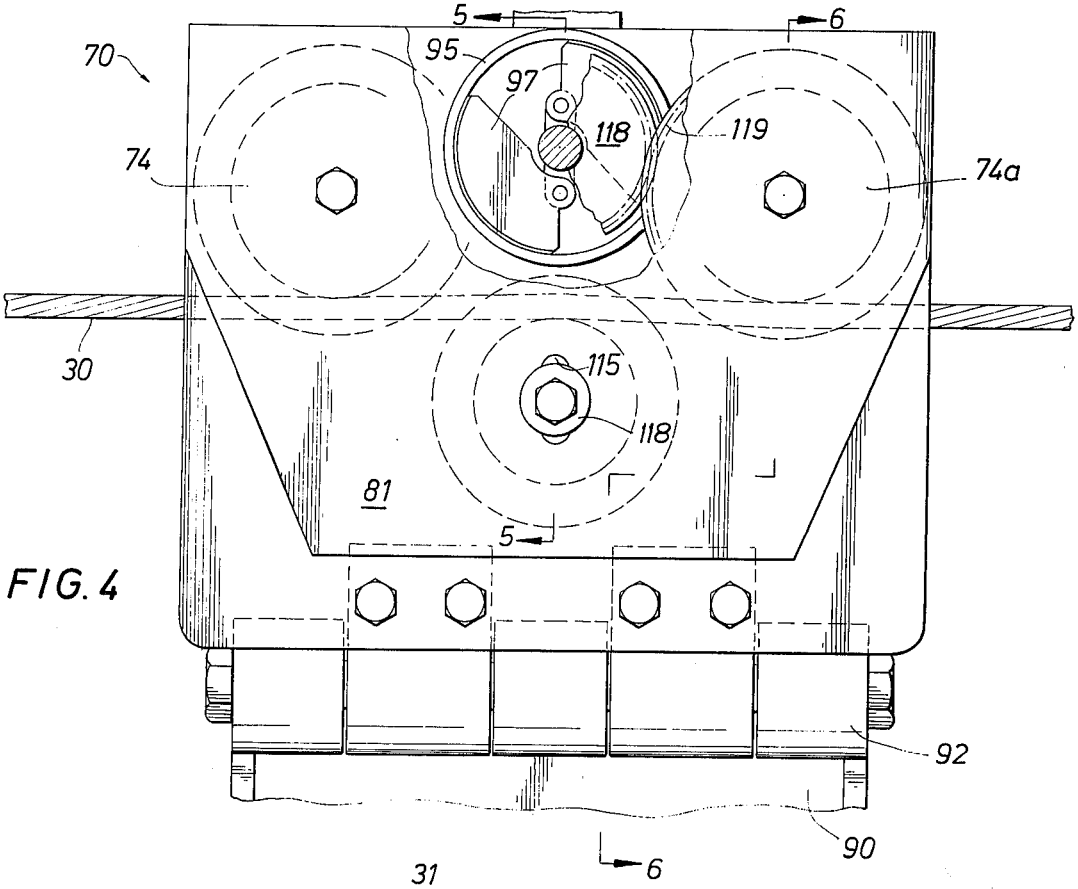
FIG. 4 is a side elevational view of a twin sheave pipe trolley which may be used in accordance with this invention.
Figure 5:
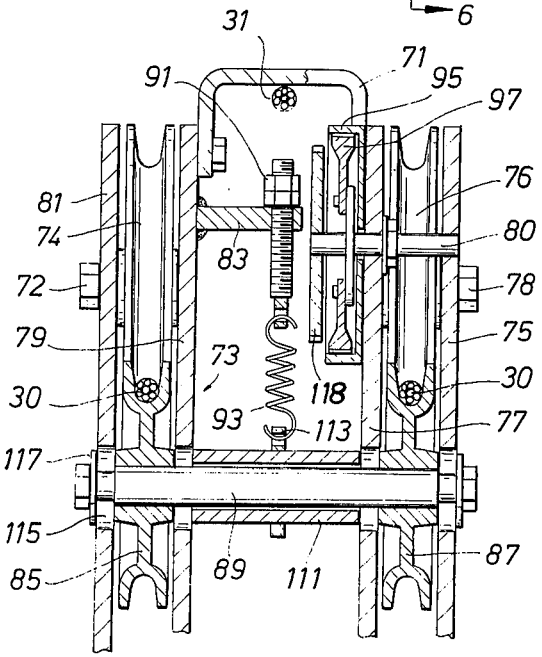
FIG. 5 is a sectional view of the twin sheave pipe trolley shown in FIG. 4 along line 5—5.

A suitable trolley for transporting the pipe of the apparatus of this invention is shown in FIGS. 4, 5 and 6. The trolley illustrated therein is a twin sheave trolley having a pair of trolley support sheaves riding on each support cable. With particular reference to FIG. 5, trolley 70 includes a trolley frame 73 comprising a first pair of pulley plates 75 and 77 surrounding trolley support sheave 76 and a second pair of pulley plates 79 and 81 surrounding trolley support sheave 74. The inner trolley plate 77 and 79 are held by cable guide 71 which is bolted to the trolley plates. It will be appreciated by reference to FIG. 4 that there is a pair of trolley support sheaves such as 74 and **74*a*** between each pair of pulley plates.

Cable guide 71 accommodates trolley cable 31 during operation and is bolted to the inner surfaces of pulley plates 77 and 79. Each of the trolley support sheaves is mounted for rotatable motion between the trolley plates on a shaft terminating in bolt heads such as shown at 72 and 78. Suspended from trolley plate 81 by swivel hinge 92 is pipe receiving bucket 90 (FIG. 6) which is suitable for receiving the pipe to be transported. The provision of swivel hinge 92 (FIG.4) prevents any swinging motion of the pipe during transport from being directly transmitted to the support cables and hence assists in providing a more stable structure. The sign of pipe receiving bucket 90 is not critical. For example, the pipe receiving bucket may be constructed from a half section of 20-inch casing or the like. Alternatively, the pipe receiving bucket may be provided with tongs or other means to frictionally or wedgedly engage the pipe when it is placed therein to prevent its sliding in the bucket. It will be noted that the lowermost trolley on the trolley means 70 is preferably provided with a rearward wall 94 (in FIG. 1) to positively prevent slippage of the pipe from the trolley.

Support cables 30 run beneath trolley support sheaves 74 and 76 as well as the corresponding subsequent pair of trolley support sheaves such as illustrated at **74*a*. It may be desirable in the trolleys used in the apparatus of this invention to provide cable clamp in the trolley which is selectively releasable, in order to prevent the trolley's movement down the support cables except as desired. Such a braking mechanism or support clamp would be most preferably used when two separate trolleys are being employed to transport the pipe rather than the trolley means 70 having the rigid pipe trough 77. In the latter case, trolley cable 31** can be used to substantially control the movement of the entire trolley means.

One embodiment of a suitable cable clamp system is illustrated in FIGS. 4 and 5. The clamping is accomplished by means of braking sheaves 85 and 87 which are biased upwardly against the cable intermediate the trolley support sheaves. Braking sheaves 85 and 87 are mounted on common shaft 89. Between trolley plates 79 and 77 shaft 89 is encased in sleeve 111 in which shaft 89 may freely rotate. Shaft 111 is provided with eye 113 which is engaged by spring 93 suspended from cross member 83 by adjustable bolt 91. Spring 93 thus biases sheaves 85 and 97 upwardly. The openings 115 in the trolley plates 75, 77, 79, and 81 are sufficiently large to accommodate vertical movement of shaft 89 to a limited extent, while washer 117 secures the bolt ends of shaft 89 from passing through openings 115. By properly selecting the tension on spring 93 and adjusting bolt 91, a braking action on the cable can be obtained when the trolley is empty. Under such circumstances, spring 93 biases sheaves 85 and 87 upwardly between trolley support sheaves, such as 74 and **74*a* and causes a sufficient crimp in cable 30 to prevent movement of the trolley independent of the cable. However, when a load is imposed in bucket 90, spring 93 yields to the weight of the imposed load and the support cable 30 tends to straighten thereby permitting trolley 70 to move on the support cables in response to the manipulation of the trolley cable 31** and gravity.

Alternatively, it may be desirable not to provide a positive clamping brake in the trolley means, but rather to provide an inertial brake so that independent movement of the trolley at significant speed down the support cables is prevented. Such inertial brakes are well known in the art. For example, in the embodiment illustrated, drum 95 is affixed to the inner wall of pulley plate 77. Shaft 80 is mounted centrally for rotation within drum 95 through pulley plates 75 and 77. Gear 118 is provided at the end of shaft 80 and is appropriately aligned to intermesh with gear 119 which is mounted on the shaft of trolley support sheave 74*a*. Flyaway weights 97 are also provided for rotation with shaft 80 and have an outer surface which can contact the inner periphery of drum 95 to afford a braking action. Accordingly, when sheave 74*a* rotates, it will induce a similar rotation in shaft 80. Such rotation of shaft 80 will cause flyaway weights 97 to push against drum 95 and thereby brake the rotation of sheave 76. Such an inertial brake may accordingly be provided to prevent the trolleys from gaining any significant speed when running freely on the cable. Generally, during the pipe handling operation, the speed of pipe transport is sufficiently low that the braking action does not substantially impede the motion of the trolley.

With reference now to FIGS. 7 and 8, there is shown a preferred embodiment of a trolley means which may be used in the pipe transport system of this invention. The trolley shown in FIGS. 7 and 8 is a single sheave trolley in that only a single support sheave is used on each of the support cables. Accordingly, this trolley is lighter, and easier to manufacture. In addition, the trolley shown in FIGS. 7 and 8 provides a clamping means in which the trolley clamps to the trolley cable rather than the support cables. Accordingly, a trolley such as illustrated herein would be useful as an upper trolley when using separated twin trolleys with the handling of pipe. In such an arrangement, the lower trolley is attached to the trolley cable, and hence no braking action would be necessary.

As illustrated in FIGS. 7 and 8, trolley 130 has a pair of inner pulley plates 131 and 133 spaced apart by means of cable guide 135 for the trolley cable. Outer trolley plates 137 and 139 are spaced from inner trolley plates 131 and 133 by means of plate spacers 143 and 141, respectively. Trolley support sheaves 145 and 147 are mounted for rotation between the trolley plates in the same manner as explained above.

Bucket 153 is suspended from the trolley by means of hinge 151 provided with pivot shaft 149. The upper portion of bucket 153 comprises a horizontal member 150 which pivots from shaft 149 and on which is provided pivoting connection 155. The lower end of shaft 159 is pivotally mounted in connection 155 and the upper end of the shaft extends upwardly through guide 161 extending outwardly from plate 137. Spring 157 is disposed between guide 161 and stop 163 on shaft 159 and tends to bias the shaft downwardly. Pivot shaft 149 is provided with an eccentric cam member 148 which accordingly is disposed to the left when the bucket is inclined and the spring biases horizontal member 150 to an inclined position. The position of the cam when the bucket is unloaded is shown in dotted outline in FIG. 7.

The braking mechanism itself can be seen in detail with particular reference to FIG. 8. Trolley cable 31 passes through the trolley below fixed ratchet 171 and movable ratchet 173 which is rotatable about pin 175. The forward end or ratchet 173 is also pinned through clamp arm 165 which is biased in a counterclockwise direction by a light spring 179. Clamp arm 165 is provided with foot 167 which rides cam 148. When the weight is placed in bucket 153, the weight tends to bias the bucket vertically against the force of spring 157 and rotates pivot shaft 149 in a clockwise direction as seen in FIG. 7. This causes cam 148 to lift foot 167 of clamp arm 165 in turn raising ratchet 173 to clamp trolley cable 31 between ratchets 173 and 171. Accordingly, the trolley illustrated in FIGS. 7 and 8 will move freely with respect to the support cables and the trolley cable when no weight is in bucket 153, but will positively latch onto trolley cable 31 when the weight is placed therein. Accordingly, when a pipe handling system utilizing two separate trolleys is employed, the use of a trolley such as trolley 130 will positively latch the upper trolley to the trolley cable whenever a pipe is placed in the bucket of the upper trolley.

It also may be desirable to provide the trolleys with means to latch at the support stand 100 disposed on the rig floor. This is particularly desirable when two separate trolleys are being used to take pipe down from the rig floor to the storage area. In such an operation, typically both trolleys are held proximate to the rig floor, the lower trolley being maintained in position by the trolley cable. In the take-down operation, the lower end of the pipe is placed first in the lower trolley and the lower trolley is permitted to proceed down the support cables as the pipe is lowered by the elevator, as explained above. However, without means to positively latch the upper trolley in position at the rig floor, the upper trolley would simply follow the lower trolley down the support cables. Of course, the cable clamping means as illustrated hereinabove with respect to the twin sheave trolleys could be used. Alternatively, however, the arrangement illustrated in FIGS. 6 and 9 could be employed.

With reference now to FIG. 6, twin sheave trolley 70 is shown with a latching mechanism, although it will be understood that the latching mechanism may be employed with either single sheave or twin sheave trolleys. The latching mechanism is operated similarly to the braking mechanism in trolley 130, in that a spring is used to bias the pipe bucket upwardly from the pipe supporting position, so that imposition of the pipe weight will overcome the spring. Bucket 90 is suspended from the trolley on pivot shaft 189 parallel to the support cables, the advantage of which is discussed above with reference to FIGS. 4 and 5. In addition, platform 191 is provided with pivot connection 193 which receives the lower end of shaft 195, the upper end of which passes through guide 197 extending outwardly from the pulley plate. Spring 198 is disposed between guide 197 and stop 199 of shaft 195 and biases the shaft downwardly thereby forcing the unweighted bucket to an inclined position as described above. Thus, when the bucket is unweighted, the upper portion 201 of shaft 195 would be in a retracted position or lowered position with respect to guide 197. When, however, a weight is placed in the bucket, the bucket will swing in a clockwise direction forcing shaft 195 upwardly and extending the upper portion 201 of the shaft significantly above guide 197.

Figure 9:
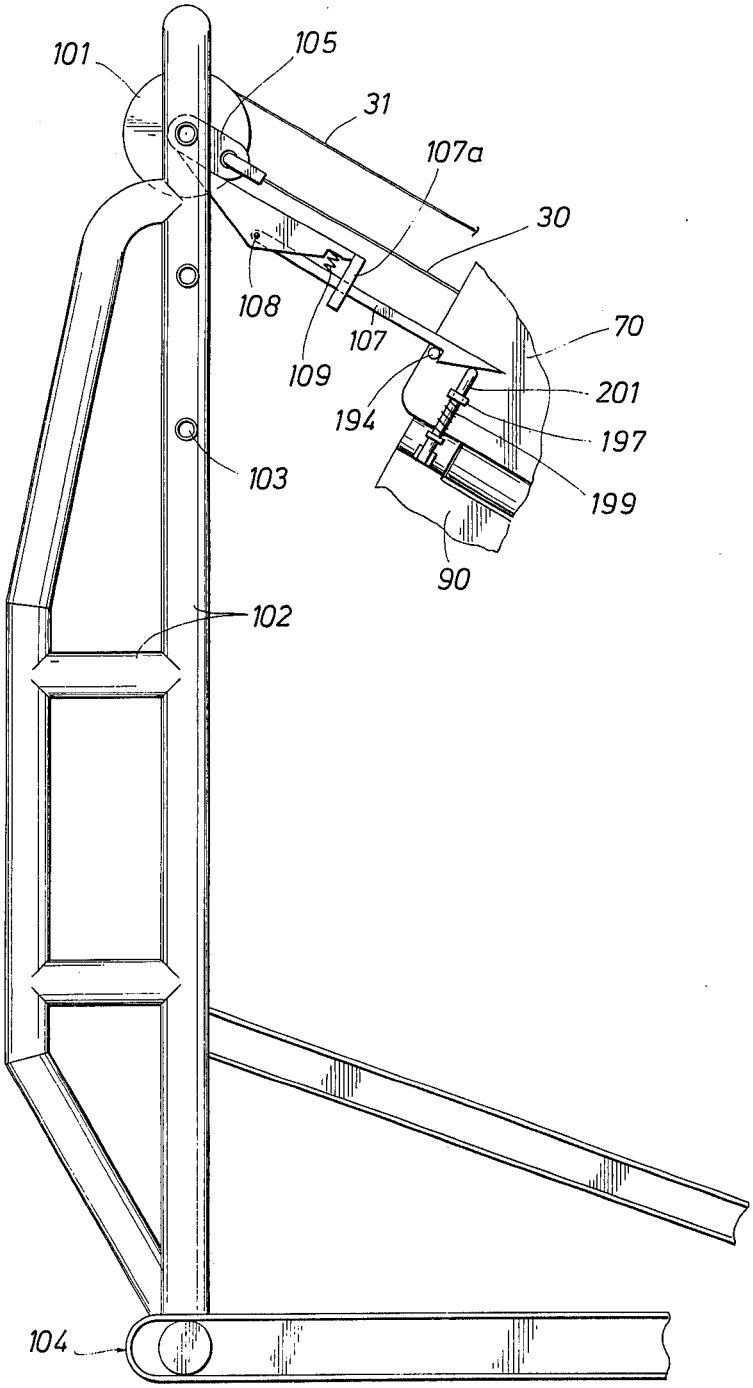
FIG. 9 is an illustration of the latching assembly which may be used at the rig for location in accordance with this invention.

As can be seen by reference to FIG. 9, the support stand may be provided with a simple latch which utilizes the motion of shaft 201 to automatically unlatch the trolley from a secure position at the support stand on the rig floor.

With reference now to FIG. 9, the latching mechanism will be seen. Trolley 70 functioning as the upper trolley in the pipe handling apparatus of this invention is shown proximate support stand 100. Upper trolley sheave 101 receives trolley cable 31 which returns around sheave 101 for attachment to the lower trolley. Support cables 30 are fixed on support stand 100 at 105. Support stand 100 is made of suitably welded frame members 102 and provided with a skid 104. In addition, auxiliary shaft receiving holes 103 are provided in the support stand to enable further adjustment of the pipe handling apparatus.

The latching apparatus comprises hook arm 107 which extends substantially parallel to support cables 30 and is pivoted at 108. Hook arm 107 is held within guide 107*a* and biased likely downwardly by spring 109. Trolley 180 is provided with a latching lug 194 extending outwardly from the side of the trolley and which is hooked by arm 107 as trolley 180 is hoisted into position proximate the support stand. Spring 109 positively latches arm 107 over latching lug 194.

It will be seen that when the trolley is unweighted, the upper portion 201 of shaft 195 rests just below the end of hook arm 107. Accordingly, when weight is placed in the bucket of the trolley, and the upper portion 201 of shaft 195 is raised as explained above, hook arm 107 will be disengaged from lug 194 and the trolley will be unlatched from the support stand.

Accordingly, in a take-down operation, the lower end of the pipe first placed in the lower trolley and the upper trolley will remain latched at the support stand. When the upper portion of the pipe is laid in the upper trolley, the trolley will automatically unlatch and permit the upper trolley to travel down with the pipe together with the lower trolley toward the storage area.

It will be understood that many different embodiments of apparatus may be constructed and remain within the spirit and scope of this invention. For example, the design of the trolleys themselves is not critical, and it will be understood that various trolleys designs and braking systems be provided by those skilled in the art. For example, trolley 70 illustrated in FIG. 6 and provided with the mechanism to automatically unlatch from the support stand could also be provided with a cable clamping brake such as illustrated in FIGS. 7 and 8. In such an arrangement, upon placing the weighted pipe in the bucket of the trolley, the trolley would at once unlatch from the support stand and simultaneously clamp the trolley cable for positive movement down the support cables to the storage area.

Other variations will also be apparent to those skilled in the art. For example, the buckets on the trolleys which receive the pipe could be provided with spring mechanism to assist in gripping the pipe when it is placed in the bucket. It will be appreciated that if the rigid trough arrangement as shown in FIG. 1 is employed, a suitable auxiliary trolley substantially along the design of those trolleys shown herein could be used. The use of the trough, however, does not preclude the use of any of the unlatching mechanisms herein described. Indeed, the entire trough can be pivotally mounted from the various trolleys, and the trolley cable clamping mechanism illustrated above or the unlatching mechanism illustrated could be used with the rigid trough trolley means. Indeed it is not necessary in employing a rigid trolley means to use an entire trough to receive the pipe. It might be suitable and desirable to simply provide several rigid members between two separated trolleys, i.e., lengths of pipe or the like, in order to provide a rigid elongated trolley means. As will be appreciated, it is preferable, however, to provide a surface intermediate the trolleys which will support the lower end of the pipe as it is being dragged out of the trolley means as has been described above.

Such variations on the apparatus and method of this invention and design alterations will be obvious to those skilled in the art.

What is claimed is:

1. Apparatus for transporting pipe-like members between the elevated floor of a well derrick and a lower storage area which comprises:

a. support cable means extending between and being supported at one end proximate said elevated floor and at the opposite end proximate said storage area and being unsupported therebetween to provide a track between said floor and said storage area;

b. trolley means for stably supporting said pipe-like member at least at two spaced points, said trolley means being adapted for travel along said support cable means and including:

i. two independently movable trolleys having means to receive and support said pipe-like member, ii. trolley cable means passing from said elevated floor, through the uppermost of said two trolleys and affixed to the lowermost of said two trolleys, and iii. holding means on said uppermost trolley to grip said trolley cable means to prevent movement of said uppermost trolley independent of said trolley cable means;

c. means to move said trolley means on said support cable means from the vicinity of said elevated floor to the vicinity of said storage area; and d. cable tensioning means having means to anchor one end of said support cable means, and having means to selectively change the unsupported length of said support cable means to enable said support cable means to assume a first slackened position wherein said two spaced points on said trolley means are disposed substantially horizontally in the vicinity of said storage area and a second position wherein said support cable means extends in a substantially direct incline from said storage area to said elevated floor.

2. The apparatus of claim 1 wherein said holding means is adapted to grip said trolley cable means when the weight of said pipe-like member is disposed in said uppermost trolley and including means releasing said holding means from said trolley cable means upon removal of said pipe-like member from said uppermost trolley.

3. Apparatus for transporting pipe-like members between the elevated floor of a well derrick and a lower storage area which comprises:

a. a pair of support cables having fixed ends extending between and being supported at one end proximate said elevated floor, and at the opposite end proximate said storage area, and being unsupported therebetween to provide a track between said floor and said storage area;

b. trolley means comprising at least upper and lower trolleys suspended from said support cables at spaced points, each of said trolleys including:

i. a trolley frame, ii. a plurality of cable-engaging sheaves adapted to ride said two support cables, iii. pipe support means for receiving said pipe-like member, said pipe support means being hingedly connected to said trolley frame along an axis substantially parallel to the path of said support cables through said trolley frame, iv. means to bias said pipe support means about the axis of its hinged connection upwardly from the pipe supporting position, v. and in the upper trolley cam means disposed on the hinged connection between said frame and said pipe support means, and vi. in the upper trolley means cooperating with said cam means to close gripping means around a trolley cable means when a pipe is in said pipe support means and said pipe support means assumes its pipe supporting position;

c. trolley cable means extending from said elevated floor and affixed to the lower trolley;

d. bidirectional power means operatively connected to said trolley cable means and adapted to control the movement of said trolleys along the track provided by said cables;

e. cable draw workds means having means to anchor one of each of said support cables, and including a plurality of cable-engaging sheaves defining a cable path for each cable through said cable draw works means; and f. means to selectively move at least one sheave in each support cable path to shorten said cable path by a fixed amount and increase the unsupported length of said cable to produce a first slackened position in said unsupported cable wherein said two spaced points of support of said pipe-like member are disposed substantially horizontally in the vincinity of said storage area, and then to lengthen said cable path to decrease the unsupported length of said cables to enable said cables to assume a second position wherein said cables extend in a substantially direct incline from said storage area to said elevated floor.

4. The apparatus of claim 3 wherein each of said trolleys includes a pair of support cable-engaging sheaves for each support cable and further including:

a. clamping sheave means disposed in said trolley frame between the pair of support cable-engaging sheaves engaging each support cable, said clamping sheave means engaging said support cable from a direction opposite the direction of engagement of said support cable by said pair of sheaves; and b. means biasing said clamping sheave means toward said pair of sheaves to produce a crimp in said support cables between said pair of sheaves.

5. The apparatus of claim 3 wherein means is provided for latching the upper trolley at said elevated floor, which comprises:

a. engaging means disposed on said elevated floor and adapted to engage said upper trolley;

b. means biasing said pipe support means upwardly from the pipe supporting position about the axis of the hinged connection between said pipe support means and said trolley means; and c. an unlatching arm adapted to move in response to the rotation of said pipe supporting means about the hinged connection, the end of said arm being disposed proximate said engaging means to displace said engaging means from engagement with said upper trolley when said pipe support means assumes the pipe supporting position.

* * * * *

UNITED STATES PATENT OFFICE

CERTIFICATE OF CORRECTION

Patent No. 4,040,524 Dated August 9, 1977

Inventor(s) William C. Lamb et al.

It is certified that error appears in the above-identified patent and that said Letters Patent are hereby corrected as shown below:

Column 7, line 60, cancel "approrpriately" and insert -- appropriately --

Column 8, line 38, after "sheaves" insert -- 45 --

Column 10, line 7, delete "sign" and insert -- design --

Column 10, line 22, after "provide" insert -- a positive --

Column 11, line 58, cancel "or" and insert -- of --

Column 15, line 15, cancel "workds" and insert -- works --

Column 15, line 16, after "one" insert -- end --

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*